United States Patent [19]

Streich et al.

[11] Patent Number: 4,873,422

[45] Date of Patent: Oct. 10, 1989

[54] WALL MOUNTED HEATER WITH PLUG MOUNT AND SUPPORT

[75] Inventors: Herbert K. Streich, Scottsdale; Robert D. Leach, Phoenix; Joel R. Johnson, Peoria; Thomas B. Olson, Paradise Valley; Donald L. Townsend, Chandler, all of Ariz.

[73] Assignee: Arvin Industries, Inc., Columbus, Ind.

[21] Appl. No.: 190,497

[22] Filed: May 5, 1988

[51] Int. Cl.[4] ..... H05B 3/02

[52] U.S. Cl. ..... 219/370; 219/366

[58] Field of Search ..... 219/366-374; 174/54, 56, 66; 439/11-13; 362/20, 33, 92, 95, 133, 226, 269

[56] References Cited

U.S. PATENT DOCUMENTS

| | | | |
|---|---|---|---|
| 1,370,527 | 3/1921 | Floriot et al. . | |
| 2,714,649 | 8/1955 | Critzer . | |
| 3,002,080 | 9/1961 | Heinzig . | |
| 3,061,716 | 10/1962 | Benander | 362/95 X |
| 3,076,887 | 2/1963 | Bulow . | |
| 3,384,977 | 5/1968 | Rosenberg . | |
| 3,739,226 | 6/1973 | Seiter et al. | 174/56 X |
| 3,780,260 | 12/1973 | Elsner | 362/92 X |
| 3,908,120 | 9/1975 | Greene | 439/13 X |
| 4,037,079 | 7/1977 | Armbruster . | |
| 4,409,536 | 10/1983 | Evjen | 174/54 X |
| 4,644,135 | 2/1987 | Daily | 219/373 X |
| 4,700,049 | 10/1987 | Rubin | 219/370 |
| 4,707,933 | 11/1987 | Keck et al. . | |

*Primary Examiner*—William M. Shoop, Jr.
*Assistant Examiner*—A. Jonathan Wysocki
*Attorney, Agent, or Firm*—Barnes & Thornburg

[57] ABSTRACT

A heater assembly is supported by an electrical receptacle mounted in a wall. A cover supports an enclosed heater and a fan forces air into the cover to be discharged into a space. A mount directly supports the cover when mated with the receptacle. To maintain the assembly in position, a contact or leg is situated below the mount and receptacle.

24 Claims, 1 Drawing Sheet

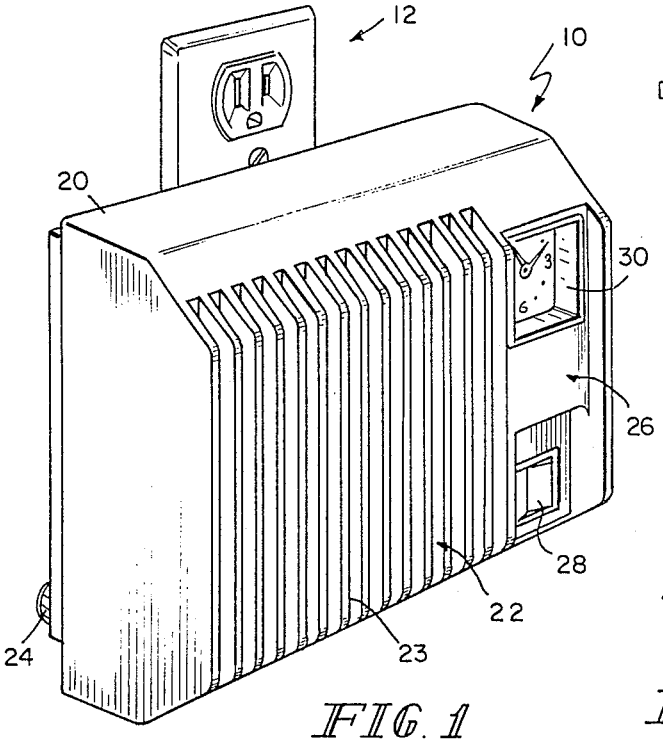
FIG. 1
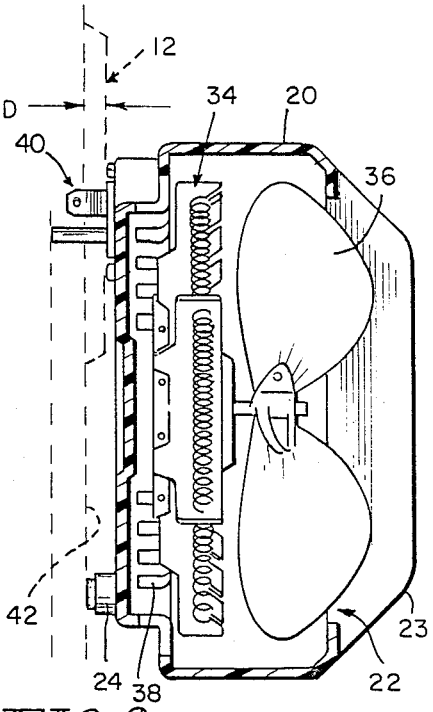
FIG. 2
FIG. 3
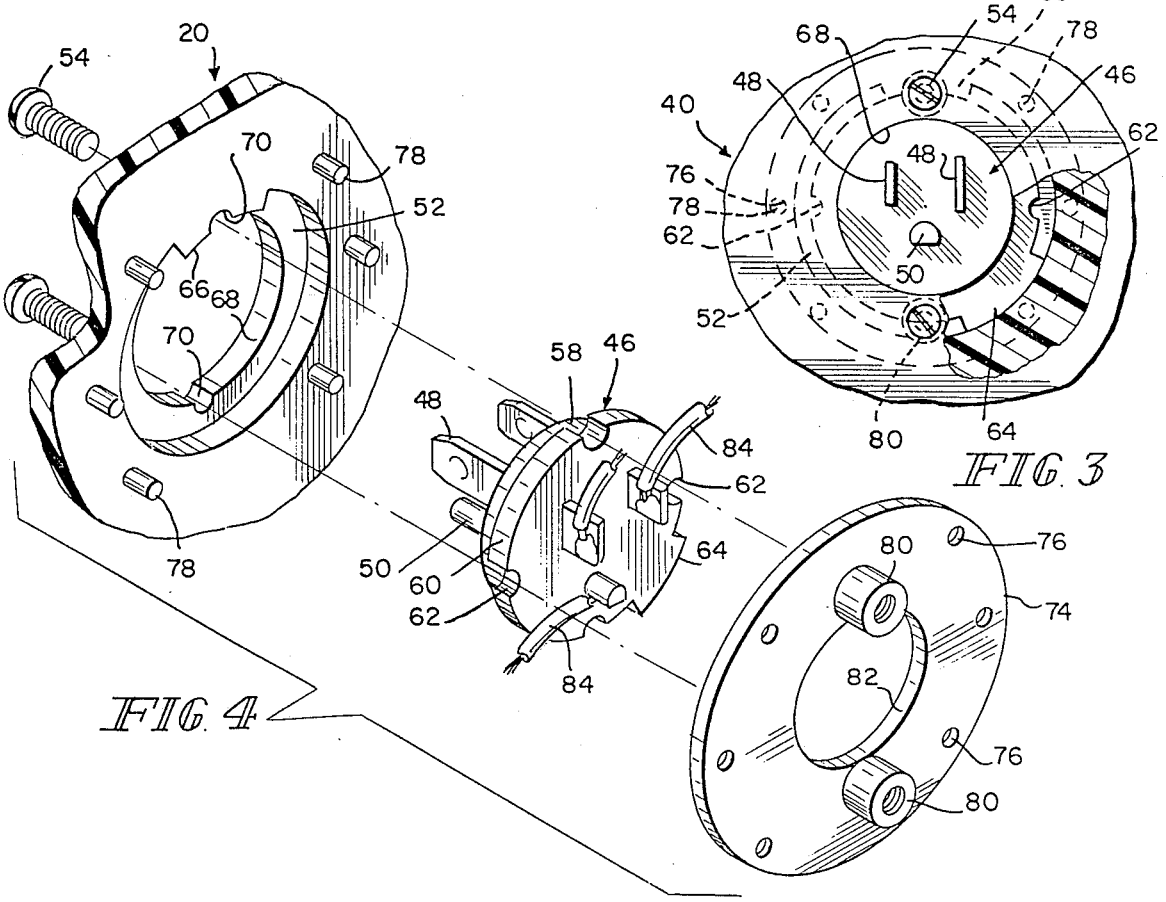
FIG. 4

WALL MOUNTED HEATER WITH PLUG MOUNT AND SUPPORT

BACKGROUND AND SUMMARY OF THE INVENTION

The present invention relates to electric heaters. More particularly, the present invention relates to an electric convection heater that is supported directly from a wall-mounted receptacle.

Conventional electric heaters designed to provide auxiliary heat for individual rooms or spaces within a house have generally been small portable units that sit on the floor. These conventional units generally have a standard length power cord which is plugged into a receptacle to provide power for the unit. With such conventional type units having power cords, their use in bathrooms has generally been limited due to the restrictions against using these types of conventional heaters near water. The possibility exists that such a conventional unit can be exposed to standing water while the unit is still receiving power through the power cord. As will be understood, this possibility can create an unsafe condition. Therefore, it would be advantageous to provide an auxiliary heating unit which could be used in a bathroom such that if the unit is displaced in any manner from its safe orientation and location, power to the unit is immediately disconnected.

Desirably, such an auxiliary heating unit would be mounted on the wall in the bathroom, with the wall being the location within the bathroom which is least likely to be exposed to standing water. Also, by mounting the unit on a wall, minimum space is taken up in the bathroom. This is advantageous because of the generally limited space in bathrooms of conventional design. Additionally, it would be desirable to be able to mount the unit in an upright orientation on the wall, no matter what the orientation of the receptacle in that wall.

It is therefore one object of the present invention to provide a heater assembly that can be utilized without a power cord.

Another object of the present invention is to provide a heater assembly that is supported directly from a wall-mounted receptacle by a power plug such that if the heater assembly should fall, power is disconnected from the heater.

Yet another object of the present invention is to provide a heater assembly that mounts close to a room wall and that is able to provide for air flow into the assembly to be heated and out of the assembly to heat the room.

Yet another object of the present invention is to provide a heater assembly which can be directly mounted in a wall-mounted receptacle with the assembly in an upright orientation even with non-standard orientations of the wall-mounted receptacle.

According to the present invention, a wall-mounted heater assembly for heating a space is provided. The heater assembly includes heater means for generating heat only when receiving electrical power. The assembly also includes cover means for supporting and enclosing the heater means. A power plug is provided that is mateable directly with a wall-mounted receptacle to provided power to the heater means only when the plug is mated with the receptacle. In addition, means for mounting the plug directly in the cover means is provided such that the plug acts to directly support the cover means only when the plug is mated with the receptacle. Also, means for forcing air into the cover means to be heated by the heater means and to be discharged out of the cover means to heat the space is provided.

One feature of the foregoing structure is that the power plug is mateable directly with a wall-mounted receptacle to provide power to the heater means only when the plug is mated with the receptacle. One advantage of this feature is that, should the heater assembly be disengaged from the wall-mounted receptacle, power is immediately removed from the assembly.

Another feature of the foregoing structure is that means for mounting the plug directly in the cover means such that the plug acts to directly support the cover means only when the plug is mated with the receptacle is provided. One advantage of this feature is that the wall-mounted receptacle and power plug cooperate to directly support the heater assembly on the wall.

In preferred embodiments of the present invention, the heater assembly includes means for rotatably orienting the power plug in the cover means in one of a plurality of angular orientations. One feature of the foregoing structure is that the angular orientation of the power plug can be selected. One advantage of this feature is that the heater assembly can be mounted in an upright orientation even with non-standard orientations of the wall-mounted receptacle.

Thus, the heater assembly of the present invention is able to be mounted directly on a wall-mounted receptacle such that, should the heater assembly be displaced from its mounted orientation, electrical power is immediately removed from the heater. This permits the heater assembly of the present invention to be used in bathroom areas which heretofor were not adaptable to conventional type electric heaters. The heater assembly can always be mounted in an upright orientation because of the provision of the selectively rotatable power plug which adapts to non-standard wall-mounted receptacle orientations.

BRIEF DESCRIPTION OF THE DRAWINGS

FIG. 1 is a perspective view of a preferred embodiment of the heater assembly of the present invention;

FIG. 2 is a transverse sectional view through the heater assembly shown in FIG. 1;

FIG. 3 is a fragmentary rear elevational view of the plug assembly; and

FIG. 4 is an exploded perspective view of the internal details of the plug assembly.

DETAILED DESCRIPTION OF THE DRAWINGS

Referring now to the drawings, and specifically to FIG. 1, FIG. 1 shows a heater assembly 10 according to the present invention. The heater assembly 10 is shown mounted in and supported by a conventional wall receptacle 12. It will be understood that the wall receptacle 12 is mounted in a conventional manner on a substantially vertical wall surface which is shown only diagrammatically in FIG. 2. The wall receptacle 12 is a conventional 110 volt power receptacle which includes two spade plug receptacles and a third ground plug receptacle in a standard configuration.

A cover 20 is provided for surrounding and containing the internal components of the heater assembly 10. The Cover 20 may be formed from any conventional material suitable for use in a heater unit. In the preferred embodiment, the cover 20 is formed from a high-impact plastic material that is able to withstand the heat generated within the assembly 10. Outlet openings 22 are formed in the front surface of the cover 20 between the vertically aligned ribs 23. Two support legs 24 (only one of which is shown in FIG. 1) extend outwardly from bottom corners of the backside of the cover 20. The use of the support legs 24 to position the heater assembly 10 on the wall surface will be discussed below.

A panel section 26 is included in a portion of the front of the cover 20. The panel section 26 may be configured to contain certain switches and other components for controlling the heater assembly 10. In the preferred embodiment illustrated in FIG. 1, the panel section 26 includes a three-position on-off switch 28. The switch 28 includes an off position where the heater assembly 10 is disabled, a fan position in which a fan only is operated, and a heat position in which the fan and the heating element within the heater assembly are operated. The fan and heating element will be discussed below in the discussion related to FIG. 2. Additionally, a clock 30 is provided in the embodiment illustrated in FIG. 1. It will be understood that the clock 30 is not necessary to the function of the heater assembly 10, and is provided in the assembly 10 only for convenience purposes. In addition, other elements or components may be optionally included in the panel section 26 in other embodiments of the heater assembly 10. For example, an automatic photoelectric night light may be included in the panel section 26, or a thermostatic control may be included to regulate the function of the heater assembly 10 as a function of the temperature in the space to be heated. Neither of these optional components are shown, however, it will be understood that these and other components which can function independently of, or in conjunction with the heater, could easily be placed in the panel section.

FIG. 2 shows in more detail the internal components of the heater assembly 10. Specifically, FIG. 2 shows a heater element 34 which is provided to heat incoming air. The heater element 34 is a conventional resistive type heater element known in the art. It will be understood that several different types of heater elements could be adapted for use in the heater assembly 10 of the present invention. A fan 36 is mounted in front of the heater element 34 and is configured to force the air heated by the heater element 34 out through the outlet openings 22 in the cover 20. The fan 36 can also be utilized independent of the heater element 34 to force unheated air through the outlet openings 22 to provide cooling air when no heat is desired.

Inlet openings 38 are formed in the rear portion of the cover 20 along the sides and bottom. The inlet openings 38 are provided to admit air into the cover 20 to be heated by the heater element 34 and forced outwardly by the fan 36 through the outlet openings 22. The orientation of the inlet openings 38 is arranged to minimize obstruction of air inflow even though the heater assembly 10 is mounted close to the wall 42 which is shown in dotted line.

A plug assembly 40 is shown mounted in the upper rear portion of the cover 20. The plug assembly 40 is configured to provide electrical power to the heater element 34 and fan 36 of the assembly 10. In addition, the plug assembly 40 is configured to directly support the heater assembly 10 from the wall receptacle 12 (shown in dotted line of FIG. 2). The plug assembly 40 extends outwardly away from the cover 20 a limited amount to prevent the cover 20 from being in direct contact with the receptacle 12. By spacing the cover 20 slightly away from the receptacle 12 and consequently the wall 42, improved air flow around the back and sides of the cover 20 is achieved.

As can be seen in FIG. 2, the support legs 24 extend away from the cover 20 an amount sufficient to permit the heater assembly 10 to be substantially parallel to the wall 42 when in the mounted condition. Thus, with the plug assembly 40 engaged in the receptacle 12, and the support legs 24 directly engaging the wall 42 as shown in FIG. 2, the heater assembly 10 will be supported in a substantially vertical orientation parallel to the wall 42. The increased length of the support legs 24 is necessary because of the thickness of the wall receptacle 12 which extends away from the wall 42 a distance indicated by the dimension D. Thus, with the plug assembly 40 fully engaged in the receptacle 12, the cover 20 is spaced apart from the wall 42 a distance slightly greater than the dimension D. The length of the support legs 24 are thus adjusted to accommodate this distance to permit the heater assembly 10 to be supported in a substantially vertical orientation.

As can be seen in FIG. 2, the plug assembly 40 provides one point of support for the heater assembly 10 near the top of the assembly 10. Because the center of gravity of the assembly 10 will be substantially near the center of the fan 36 and heater element 34, the point of support provided by the plug assembly 40 will be above the center of gravity. Likewise, the point of support of the legs 24 will be below the center of gravity of the assembly 10. By providing points of support both above and below the center of gravity of the heater assembly 10, the heater assembly 10 is able to be mounted on the wall 42 in a stable orientation, with little tendency to move or fall.

FIG. 3 shows in greater detail the structure and orientation of the plug assembly 40. Specifically, the plug assembly 40 includes a rotating plug member 46 which includes two power spade connectors 48 and a ground prong 50. The orientation of the connectors 48 and the ground prong 50 is conventional for a 110 volt AC power connector. The rotating plug member 46 is mounted in the cover 20 such that the rotating plug member 46 is permitted to be selectively angularly oriented to one of four orientations. This flexibility in angular orientation of the rotating plug member 46 is necessary to permit the plug assembly 40 to be plugged into non-standard wall receptacles 12 with orientations other than the orientation of the receptacle 12 illustrated in FIG. 1, and to still permit the heater assembly 10 to remain in the upright orientation. It will be understood that some non-standard wall receptacles 12 may be oriented 90 degrees in either direction to the configuration illustrated in FIG. 1, or may be oriented 180 degrees to the orientation of the connector receptacles in FIG. 1.

The rotating plug member 46 is fitted into a annular groove 52 in the cover 20 which is shown in phantom in FIG. 3. Screws 54 are provided to lock the rotating plug member in one of the four permitted angular orientations.

FIG. 4 illustrates in even greater detail the mounting of the rotating plug member 46 to permit selective angular orientation of the rotating plug member 46 within the cover 20. A broken-away portion of the cover 20 is shown in FIG. 4 and includes a aperture 68 which is sized to receive an annular body portion 58 of the rotating plug member 46. The annular groove 52 is shown formed adjacent to this aperture 68. The rotating plug member 46 includes a flange portion 60 which is received in the annular groove 52 when the rotating plug member 46 is inserted into the aperture 68. The flange portion 60 is sized to be received within the annular groove 52 to permit rotation within that groove 52.

Four notches 62 are formed in the flanged portion 60 and spaced 90 degrees apart from each other. A stop arm 64 is formed on the flanged portion 60 and is configured to engage one of the two faces of the shoulder 66 which extends into the annular groove 52. The stop arm 64 and shoulder 66 cooperate to prevent the rotating plug member 46 from being rotated more than about 350 degrees. It is necessary to prevent the rotating plug member 46 from rotating more than this amount to prevent leads 84 which are attached to the spade connectors 48 and ground prong 50 from being twisted and possibly damaged.

Two notches 70 are formed in the aperture 68 and the cover 20 and are sized to receive the screws 54 which extend through the notches 70 and through the corresponding notches 62 formed in the flanged portion 60 of the rotating plug member 46 when the rotating plug member 46 is properly aligned in one of the four angular orientations. A back plate 74 is provided which functions to capture the rotating plug member 46 in the aperture 68 and annular groove 52. The back plate 74 is formed to include a plurality of holes 76. The holes 76 are arranged to receive the plurality of posts 78 formed on the inner surface of the cover 20. With the rotating plug member 46 inserted in the aperture 68 such that the flange portion 60 is captured in the annular groove 52, the back plate 74 is mated with the inner surface of the cover 20 such that the posts 78 extend into the holes 76. The posts 78 are then ultrasonically welded or otherwise remolded so that the back plate 74 is securely mated to the inner surface of the cover 20 to capture securely the rotating Plug member 46. The back plate 74 is formed to include an aperture 82 through which the wire leads 84 attached to the rotating plug member 46 extend. Two threaded bores 80 are formed in the back plate 74 which are configured and sized to receive the screws 54 to lock the rotating plug member 46 in one of the four angular orientations.

To change the angular orientation of the rotating plug member 46, the two screws 54 are first removed. Following that, the rotating plug member 46 is rotated to one of the three remaining orientations, each of which are spaced 90 degrees apart. As discussed above, the stop arm 64 and shoulder 66 cooperate to prevent the rotating plug member 46 from being rotated more than approximately 350 degrees to prevent damage to the wire leads 84. The rotating plug member 46 is rotated to the desired angular orientation, for example, 180 degrees from that shown in FIG. 4, until the notches 62 on the flange portion 60 align with the notches 70 in the aperture 68. With the rotating plug member 46 properly oriented and the notches 62, 70, aligned, the screws 54 are replaced to lock the rotating plug member 46 in the desired angular orientation. It will be understood that this change in the angular orientation of the rotating plug member 46 may be done to permit the heater assembly 10 to be supported in the normal upright orientation should the orientation of the wall receptacle be other than that illustrated in FIG. 1. Thus, although changing the angular orientation of the rotating plug member 46 is relatively simple and easy to accomplish, the change will not be necessary other than to permit the heater to be plugged in to wall receptacles with different angular orientations.

Thus, the heater assembly 10 of the present invention provides a compact heating unit which is configured to be used in bathrooms and other areas where it may not be possible or desirable to use conventional heating units. The heater assembly 10 is supported directly from the wall receptacle 12, and consequently should the heater assembly 10 be bumped such that the heater assembly 10 falls away from the wall receptacle 12, power to the heater assembly 10 is immediately interrupted.

Although the invention has been described in detail with reference to a preferred embodiment and specific examples, variations and modifications exist within the scope and spirit of the invention as described in the following claims.

What is claimed is:

1. A heater assembly for heating a space contained at least in part by a wall, the heater assembly being adapted to be supported by an electrical receptical mounted in the wall, the heater assembly comprising, heater means for generating heat when receiving electrical power, cover means for supporting and enclosing the heater means, means for forcing air into the cover means to be heated by the heater means and to be discharged out of the cover means to heat the space, a plug that is mateable directly with the wall-mounted electrical receptacle to provide power to the heater means only when the plug is mated with the receptacle, mounting means for mounting the plug directly in the cover means such that the plug acts to directly support the cover means only when the plug is mated with the receptacle, and contact means situated below the plug and adapted to contact the wall below the receptacle so that the entire heater assembly is maintained in position solely by the plug and contact means.

2. The heater assembly of claim 1, wherein the mounting means includes means for rotatably orientating the plug in one of a plurality of angular orientations.

3. The heater assembly of claim 2, wherein the mounting means comprises a mounting bracket which includes an aperture for receiving the plug in one of the plurality of angular orientations.

4. The heater assembly of claim 3, wherein the mounting means includes means for locking the plug against rotation in one of the plurality of angular orientations.

5. The heater assembly of claim 4, wherein the mounting bracket includes at least one channel which extends along a longitudinal axis of the aperture in the periphery of the aperture, and the locking means comprises a screw which engages the channel and the plug to prevent rotation of the plug within the aperture.

6. A heater assembly mountable to an electrical receptacal on a wall containing a space for heating the space, the heater assembly comprising, a heating element for generating heat when receiving electrical power, a cover that surrounds and supports the heating element, the cover and the heating element having a center of gravity, a plug extending from the cover to mate directly with a wall-mounted receptacle to provide power to the heating element, the plug providing a point of support for the assembly above said center of gravity, and at least one leg member extending from the cover below the center of gravity to provide a point of contact for the heater assembly, whereby the entire heater assembly is maintained in position close to the wall solely by the plug and that at least one leg member.

7. The heater assembly of claim 6, further comprising means for rotatably mounting the plug in the cover such that the plug is permitted to rotate within the cover about a longitudinal axis of the plug.

8. The heater assembly of claim 7, wherein the mounting means comprises a mounting bracket which is formed to include an aperture for receiving the plug in one of a plurality of selected angular orientations.

9. The heater assembly of claim 6, further comprising means for forcing air into the cover to be heated by the heating element and to be discharged out of the cover to heat the space.

10. The heater assembly of claim 7, wherein the mounting means includes means for selectively locking the plug against rotation in one of the plurality of angular orientations.

11. A heater assembly for heating a space contained at least in part by a wall, the heater assembly being adapted to be supported by an electrical receptical mounted in the wall, the heater assembly comprising, a shroud-like cover including air inlet openings and separate air outlet openings, said including leg means projecting rearwardly adjacent a lower perimenter of the cover.

forcing means for forcing air into the cover through the inlet openings and out of the cover through the outlet openings, a heater element enclosed by and supported within the cover for heating the air forced through the cover by the forcing means, a plug mateable directly with the wall-mounted electrical receptacle to provide power to the heater element and for supporting heater assembly from the receptacle only when mated with the receptacle such that when the plug is mated with the receptacle the heater is substantially adjacent the receptacle and the wall, and mounting means for rotatably mounting the plug in the cover to permit the plug to be selectively rotated within the cover to one of a plurality of angular orientations to ensure the leg means is situated below the plug.

12. The heater assembly of claim 11, wherein the mounting means includes means for selectively locking the plug in one of the plurality of angular orientations.

13. The heater assembly of claim 11 wherein the plug is situated adjacent an upper margin of the cover above the center of gravity of the assembly.

14. The heater assembly of claim 11 wherein the plug mounting means includes an annular groove and the plug includes a flange portion received in the annular groove, the flange portion and groove being sized to permit rotation.

15. The heater assembly of claim 14 wherein the flange portion of the plug includes an outwardly extending stop arm and the groove includes an inwardly extending shoulder, the stop arm and shoulder cooperating to prevent the plug from being rotated more than about 350° with respect to the cover.

16. The heater assembly of claim 11 further comprising means for limiting the rotation of the plug with respect to the cover to less than 360°.

17. The heater assembly of claim 14 wherein the mounting means further comprises plate means fixed to the cover for capturing the flange portion of the plug within the groove, the plate means including a central opening to permit electrical connection between the plug and the heater element.

18. A heater assembly for heating a space and adapted to be held on a wall containing the space by an electrical plug receptacle mounted in the wall, the heater assembly comprising, a shroud-like cover having a front face, a back face and a perimeter connecting the front and back faces, the cover including air inlet openings and separate air outlet openings, fan means situated within the cover for forcing air into the cover through the inlet openings and out of the cover through the outlet openings, a heating element enclosed by and supported within the cover for heating the air forced through the cover by the forcing means, the fan, the cover and the heating element having a center of gravity, an electrical plug extending from the back face of the cover adjacent an upper portion of the perimeter for engagement in the wall-mounted electrical plug receptacle to provide power to the heating element and fan means, the plug providing a point of support for the assembly above the center of gravity, at least one leg member extending from the cover below the center of gravity to provide a point of contact for the heater assembly with respect to the wall so that the entire heater assembly is situated adjacent to the wall solely by the plug and the at least one leg member, and mounting means for rotatably mounting the plug in the cover such that the plug is permitted to rotate within the cover about a longitudinal axis of the plug, and means for selectively locking the plug against rotation in one of a plurality of angular orientations to ensure that the center of gravity is situated below the plug.

19. The heater assembly of claim 18 wherein the plug mounting means comprises an annular groove, the plug including a flange portion received in the annular groove, the flange portion and groove being sized to permit rotation, the flange portion of the plug including an outwardly extending stop arm, the groove including an inwardly extending shoulder, the stop arm and shoulder cooperating to prevent the plug from being rotated more than about 350° with respect to the cover.

20. The heater assembly of claim 18 wherein the at least one leg member comprises a pair of legs spaced apart and extending rearwardly from the back face of the cover adjacent a lower portion of the perimeter.

21. The heater assembly of claim 18 further comprising switch means mounted on the cover and electrically connected between the plug and the heating element and fan means for controlling operation of the heater assembly.

22. The heater assembly of claim 21 further comprising connecting means between the switch means and the fan means for permitting operation of the fan means independent of the heating element.

23. The heater assembly of claim 18 wherein the electrical plug and the at least one leg member projects sufficiently far from the cover to space the cover from the wall when the plug is fully installed in the electrical plug receptacle to provide air flow around the back face of the cover.

24. The heater assembly of claim 23 wherein the at least one leg member projects sufficiently far from the cover so as situate the front face of the cover in a substantially vertical plane parallel to the wall when the plug is fully installed in the electrical plug receptacle.

* * * * *